US006957942B2

(12) United States Patent
Agace

(10) Patent No.: US 6,957,942 B2
(45) Date of Patent: Oct. 25, 2005

(54) AUTONOMOUS CASK TRANSLOCATION CRANE

(75) Inventor: Stephen J. Agace, Marlton, NJ (US)

(73) Assignee: Holtec International, Inc, Marlton, NJ (US)

( * ) Notice: Subject to any disclaimer, the term of this patent is extended or adjusted under 35 U.S.C. 154(b) by 35 days.

(21) Appl. No.: 10/379,636

(22) Filed: Mar. 4, 2003

(65) Prior Publication Data

US 2004/0175259 A1 Sep. 9, 2004

(51) Int. Cl.[7] ..... B66C 1/10
(52) U.S. Cl. ..... 414/680; 414/800
(58) Field of Search ..... 414/680, 800, 414/806; 212/255, 259, 261; 254/264, 1

(56) References Cited

U.S. PATENT DOCUMENTS 3,797,877 A * 3/1974 Soehrens ..... 294/67.1
3,889,926 A * 6/1975 Ahlgren ..... 254/1
4,383,791 A * 5/1983 King ..... 414/680 X

* cited by examiner

*Primary Examiner*—Donald W. Underwood
(74) *Attorney, Agent, or Firm*—Cozen O'Connor PC; Michael B. Fein; Brian L. Belles

(57) ABSTRACT

An apparatus and method for transferring spent nuclear fuel within a nuclear power plant. In one aspect, the invention is an apparatus for transferring a cask from a first position to a second position comprising: a first beam having a first proximal end and a first distal end, said first proximal end adapted for pivotal connection to a base; a second beam having a second proximal end and a second distal end, said second proximal end adapted for pivotal connection to said base; a member connecting said first distal end and said second distal end, said member comprising a lifting device adapted to raise and lower said cask; wherein said member, said first pivot beam, and said second pivot beam form a unitary structure; and means to rotate said unitary structure about an axis. In another aspect, the invention is a method of using the apparatus to transfer a cask.

18 Claims, 11 Drawing Sheets

AUTONOMOUS CASK TRANSLOCATION CRANE

TECHNICAL FIELD OF THE INVENTION

This invention relates generally to the field of storage and transfer of spent nuclear fuel and specifically to apparatus and methods used to lift and move casks in nuclear power plants.

BACKGROUND ART

In the operation of nuclear reactors, hollow zircaloy tubes filled with enriched uranium, known as fuel assemblies, are burned up inside the nuclear reactor core. It is customary to remove these fuel assemblies from the reactor after their energy has been depleted down to a predetermined level. Upon depletion and subsequent removal, this spent nuclear fuel ("SNF") is still highly radioactive and produces considerable heat, requiring that great care be taken in its subsequent packaging, transporting, and storing. Specifically, the SNF emits extremely dangerous neutrons and gamma photons. It is imperative that these neutrons and gamma photons be contained at all times subsequent to removal from the reactor core.

In defueling a nuclear reactor, it is common to remove the SNF from the reactor and place the SNF under water, in what is generally known as a spent fuel pool or pond storage. The pool water facilitates cooling of the SNF and provides adequate radiation shielding. The SNF is stored in the pool for a period long enough to allow the decay of heat and radiation to a sufficiently low level to allow the SNF to be transported with safety. However, because of safety, space, and economic concerns, use of the pool alone is not satisfactory where the SNF needs to be stored for any considerable length of time. Thus, when long-term storage of SNF is required, it is standard practice in the nuclear industry to store the SNF in a storage cask subsequent to the brief storage period in the spent fuel pool.

Storage casks have a cavity adapted to receive a canister of SNF and are designed to be large, heavy structures made of steel, lead, concrete and an environmentally suitable hydrogenous material. However, because the focus in designing a storage cask is to provide adequate radiation shielding for the long-term storage of SNF, size and weight are often secondary considerations (if considered at all). As a result, the weight and size of storage casks often cause problems associated with lifting and handling. Typically, storage casks weigh more than 100 tons and have a height greater than 15 ft. A common problem associated with storage casks is that they are too heavy to be lifted by most nuclear power plant cranes. Another common problem is that storage casks are generally too large to be placed in spent fuel pools. Thus, in order to store SNF in a storage cask subsequent to being cooled in the pool, the SNF must be removed from the pool, placed in a staging area, prepared for dry-storage, and transported to a storage facility. Adequate radiation shielding is needed throughout all stages of this transfer procedure.

As a result of the SNF's need for removal from the spent fuel pool and additional transportation to a storage cask, an open canister is typically submerged in the spent fuel pool. The SNF rods are then placed directly into the open canister while submerged in the water. However, even after sealing, the canister alone does not provide adequate containment of the SNF's radiation. A loaded canister cannot be removed or transported from the spent fuel pool without additional radiation shielding. Thus, apparatus that provide additional radiation shielding during the transport of the SNF is necessary. This additional radiation shielding is achieved by placing the SNF-loaded canisters in large cylindrical containers called transfer casks while still within the pool. Similar to storage casks, transfer casks have a cavity adapted to receive the canister of SNF and are designed to shield the environment from the radiation emitted by the SNF within.

In facilities utilizing transfer casks to transport canisters loaded with SNF, an empty canister is first placed into the cavity of an open transfer cask. The canister and transfer cask are then submerged in the spent fuel pool. The SNF that has been removed from the reactor and placed in wet storage racks arrayed on the bottom of spent fuel pools is then placed within the canister. The loaded canister is fitted with its lid. This loading operation is performed under water using remotely operated tools for grappling, lifting and placing.

The loaded canister and transfer cask are then removed from the pool by a crane and set down in a staging area to prepare the SNF-loaded canister for long-term dry storage in a storage cask. Once prepared, the transfer cask is transferred from the staging area and set atop a storage cask for transfer of the SNF-loaded canister.

Due to the extremely dangerous neutrons and gamma photons emitted by the SNF, transfer casks are typically designed to be large cylindrical vessels equipped with thick walls to provide radiation shielding to personnel. As such, transfer casks are very heavy structures, often weighing over 75 tons. When loaded with SNF and water, the weight can exceed 120 tons.

To lift and position transfer casks, nuclear power plants are equipped with overhead cranes that can access the spent fuel pool and the plant equipment receiving areas. The plant's crane must have sufficient capacity to support the weight of the loaded transfer cask, have sufficient range to access both the plant's spent fuel pool, canister staging area, cask loading area, and equipment receiving area. The capacity of the crane depends on the plant's crane lift rating and the ability of the crane's supporting structure to bear the load.

Many older and smaller nuclear power plants do not have sufficient crane capacity to lift and position larger transfer casks that have been developed. The process of upgrading the crane to a higher capacity is hindered by building structural limitations. Moreover, older power plants' supporting structures are often of unknown structural capability or are fabricated from materials that may not have the structural properties necessary to meet current safety requirements for lifting nuclear materials.

Many of the older plants have been shut down and possess a relatively few number of spent fuel assemblies so the cost of providing an upgraded crane and improved supports cannot be financially justified.

Cask lifting devices must have the ability to be able to strategically place the load-bearing members over high strength locations in the building and utilize combinations of specialized lifting components that do not interfere with the plant's existing fuel handling systems and crane. The device must provide adequate protection against such things as power failure, uncontrolled lowering of the load under a postulated failure of a single component, and uncontrolled lowering of the load under earthquake conditions. Specialty devices which provide protection against uncontrolled lowering of the load require large components that are expensive, difficult to install, and interfere with the existing plant structures, systems and components.

DISCLOSURE OF THE INVENTION

It is therefore an object of the present invention to provide an apparatus and method for transferring a cask that requires less space.

A further object of the present invention is to provide and apparatus and method for transferring a cask that does not require the use of an overhead crane.

Another object of the present invention to provide an apparatus and method for transferring a cask device which provides protection against uncontrolled lowering of a cask.

Yet another object of the present invention to provide an apparatus and method for transferring a cask that can be more easily installed in existing spent nuclear fuel storage facilities than prior devices and existing specialty cask lifting devices.

A still further object of the present invention to provide an apparatus and method for transferring a cask that it can be installed more cheaply than existing lifting devices.

It is also an object of the present invention to provide an apparatus and method for transferring a cask that does not interfere with existing plant structures, systems and components.

Additional objects and advantages of the invention will be set forth in the description that follows and will become apparent to those skilled in the art upon examination of the following or may be learned with the practice of the invention. The objects and advantages of the invention may be realized and obtained by means of the instrumentalities and combinations particularly pointed out in the claims.

In one aspect, the invention is an apparatus for transferring a cask comprising: a first beam having a first proximal end and a first distal end, said first proximal end adapted for pivotal connection to a base; a second beam having a second proximal end and a second distal end, said second proximal end adapted for pivotal connection to said base; a member connecting said first distal end and said second distal end, said member comprising a lifting device adapted to raise and lower said cask; wherein said member, said first pivot beam, and said second pivot beam form a unitary structure; and means to rotate said unitary structure about an axis. It is preferable that the lifting device further comprise means to engage the cask, such as a lifting yoke. Preferably, the lifting device will further comprise one or more strand jacks.

The unitary structure of the apparatus is preferably an upside-down substantially U-shaped structure. The upside down U-shaped structure and lifting device should preferably be designed for low-clearance. The rotating feature allows the load to rest directly over high-strength locations in the floor of the building where the increased load can be sustained. It is preferred that the apparatus have features to enable attachment to the plant structure for stabilization.

It is further preferable that the member be pivotally connected to the first and second distal ends of the first and second beams. This will maintain the lifting device in a horizontal orientation as the unitary structure pivots, although a non-rotating version may also be used. The rotational means can comprise one or more hydraulic cylinders. The ability of hydraulic cylinders to be able to push and pull are considerations which lead to the choice of hydraulics. In this embodiment, it is preferable that the rotational means be first and third hydraulic cylinders pivotally connected to opposing sides of the first beam and second and fourth hydraulic cylinders pivotally connected to opposing sides of the second beam. The use of four hydraulic cylinders ensures stability and increases the amount of torque that can be applied to the unitary structure for rotation.

The apparatus can further comprise the base which can be in the form of a base frame. The base frame is preferably included for pivotally connecting the first and second beams and for spreading the load to strong points on the floor of the plant, providing a stable base for supporting the cask. Alternatively, a base frame does not have to be used and the first and second beams can be pivotally secured directly to the floor or any other structurally sound portion of the power plant.

In the embodiment of the apparatus where a base frame is used, it is preferred that the base frame comprise first and second carriages and first and second tracks wherein the first and second carriages are adapted to ride on the first and second tracks respectively. It is further preferable that the first and second beams be pivotally connected to the first and second carriages respectively. This allows translational motion of the unitary frame with respect to the tracks. In order to not interfere with the translational motion of the unitary frame, rotation is preferably assisted by first, second, third, and fourth hydraulic cylinders. The first and third hydraulic cylinders are preferably connected to opposing sides of the first beam and to the first carriage. The second and fourth hydraulic cylinders are preferably connected to opposing sides of the second pivot beam and to the second carriage.

In alternative embodiment of the apparatus where a base frame is used, the first and second beams are pivotally connected to the base frame so that the unitary structure is incapable of translational motion with respect to the base frame. This is achieved by pivotally connecting the first and second beams to first and second mounting brackets fixedly secured to the base frame.

Using a substantially upright position of the unitary frame as a reference point, the first and second beams are preferably adapted to pivotally connect to the base to allow the unitary structure to rotate in both a clockwise and counter-clockwise direction from the reference point. This rotating ability of the unitary structure allows the apparatus to operate from one side of a cask loading area and move the cask to the opposite side of the axis of rotation without having to straddle the loading area, allowing unimpeded movement of fuel assembly handling equipment.

In another aspect, the invention is a method of transferring a cask comprising: lifting the cask from a first position with the apparatus discussed above; rotating said unitary structure about said axis so that said cask is above a second position; and lowering said cask onto said second position.

The method can be used when the first position is within a spent fuel pool and the second position is a staging area. Additionally, the first position can be a staging area and the second position can be atop a storage cask.

In one embodiment of the method, the base is adapted to allow translational movement of the unitary structure and the method will further comprise translationally moving said unitary structure; lifting said cask from said second position; rotating said unitary structure about said axis so that said cask is above a third position; and lowering said cask onto said third position.

It is also preferable that during the rotating step that the cask pass between the first and second beams before becoming positioned above the second position. Additionally, the method can further comprise installing a canister lid on a canister of SNF with the apparatus.

The method and apparatus of the present invention can also be used in conjunction with means to move the cask horizontally throughout the plant, such as a flat bed system with rollers. In this embodiment, the second position will be atop the flat bed and the cask will be lowered onto the flat bed system for further transport throughout the plant. The flat bed system is used because the cask is typically too heavy to be supported directly on the building's floor. The carriage provides a strong flat base for the cask to sit. The rollers provide the means to move the flat bed that is supporting the cask. Where the elevations differ, the cask transfer procedure may consist of multiple apparatus suitably positioned or a moveable apparatus.

It is preferred that the method and apparatus be implemented so that the base frame direct the load to major load bearing portions of the plant, such as walls, beams and floor support columns, although load spreading devices may also be used where appropriate.

MODES FOR CARRYING OUT THE INVENTION

The preferred embodiments will be illustrated with reference to the drawings. Various other embodiments should become readily apparent from this description to those skilled in this art.

Figure 1:
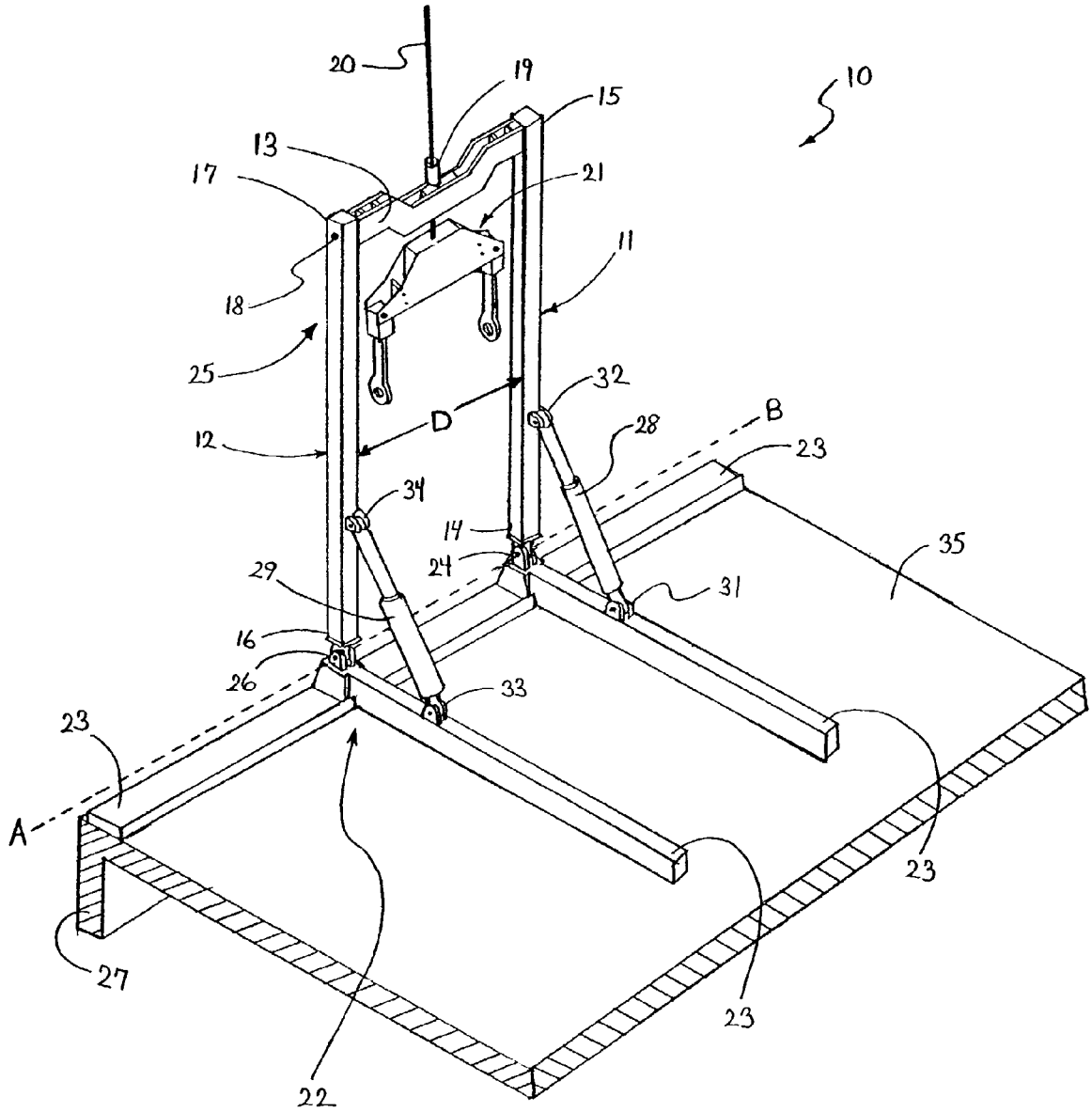
FIG. 1 is an isometric view of a first embodiment of a cask translocation crane according to the present invention.

Referring to FIG. 1, a first embodiment of cask translocation crane 10 is illustrated. Cask location crane 10 comprises first beam 11 and second beam 12. First beam 11 has a first proximal end 14 and a first distal end 15. Similarly, second beam 12 has a second proximal end 16 and a second distal end 17. Cask location crane 10 also comprises member 13 interposed between first distal end 15 of first beam 11 and second distal end 17 of second beam 12. Member 13 pivotally connects to first beam 11 and second beam 12 at pivot point 18 (see FIG. 2 also). The pivotal connection between member 13 and first beam 11 and second beam 12 can be made by any means known in the art, including a hole and pin assembly or a bearing assembly. Despite member 13 being able to rotate with respect to first beam 11 and second beam 12 about pivot point 18, member 13, first beam 11, and second beam 12 form a unitary structure 25 with respect to rotation about axis A-B. As used herein, this means, for example, that if a rotational force is applied to any one of first beam 11, second beam 12, or member 13 causing it to rotate about axis A-B, the entire unitary structure 25 will correspondingly rotate about axis A-B.

Figure 2:
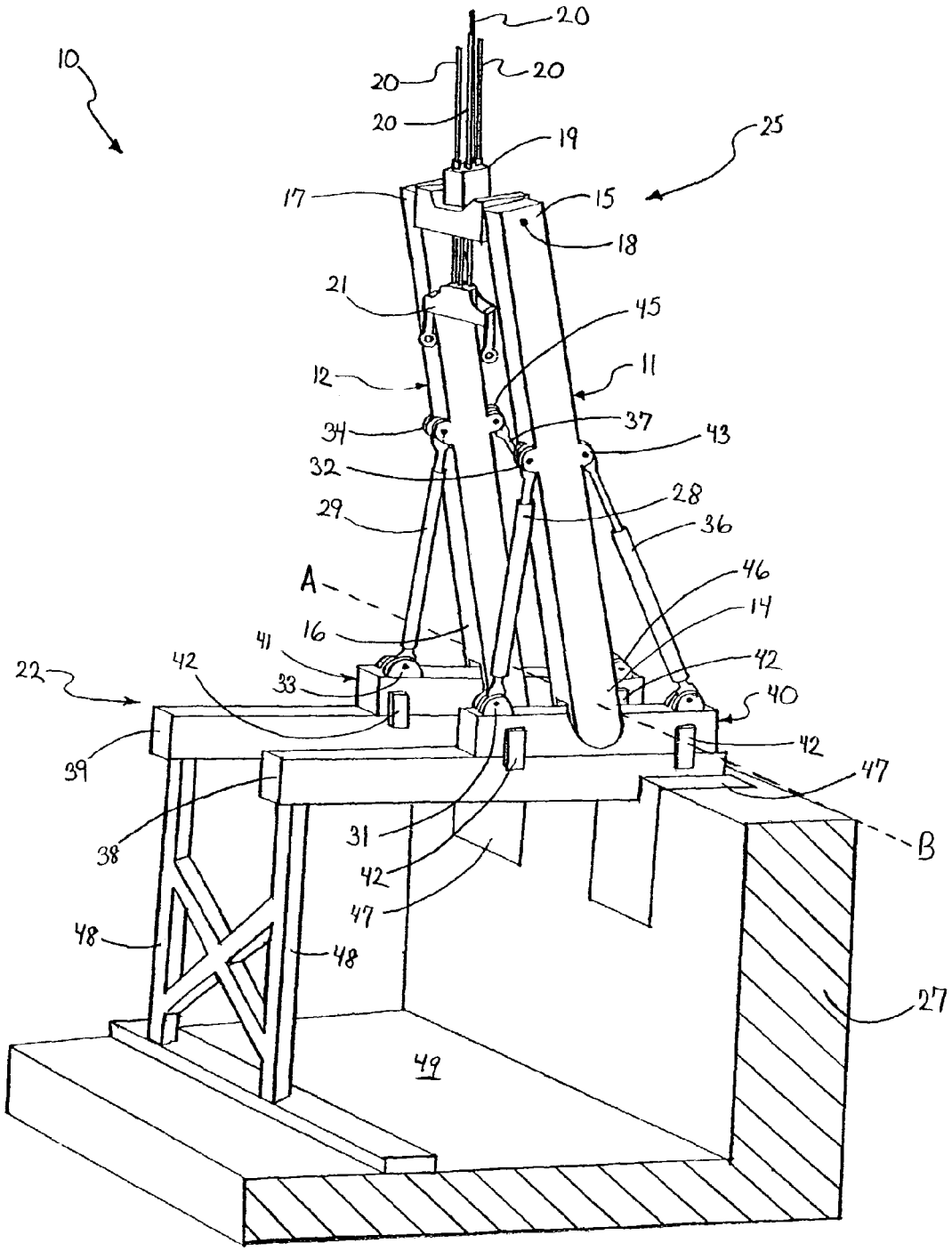
FIG. 2 is an isometric view of a second embodiment of a cask translocation crane according to the present invention positioned adjacent to a spent fuel pool.

Member 13 comprises strand jack 19 operably coupled with braided cable 20. Braided cable 20 is connected to lifting yoke 21. Lifting yoke 21 is adapted to engage a cask 30 (FIG. 3) for lifting and transporting. By turning strand jack 19 in the appropriate direction, cask 30 and lifting yoke 12 can be raised or lowered through the threaded interaction of strand jack 19 with braided cable 20. While a single strand jack and braided cable are illustrated, the present invention is not so limited. It may be necessary to use a plurality of strand jacks and braided cables to properly support and lift a cask and lifting yoke while remaining within acceptable safety standards. The exact number of strand jacks and braided cables necessary are a matter of design that will depend on the weight of the load to be lifted. It is preferred that a hydraulic strand jack be used in a strand cluster arrangement (as is illustrated in FIG. 2). This provides redundancy in the event of a single strand failure.

Cask location crane 10 further comprises a base frame 22 which serves as a base support for unitary structure 25 (which consists of member 13, first beam 11, and second beam 12). Base frame 22 is formed of rectangular bars 23 that are secured to floor 35. A pair of first mounting plates 24 and a pair of second mounting plates 26 are secured to the surfaces of two of the rectangular bars 23. First beam 11 pivotally connects to first mounting plates 24 while second beam 12 pivotally connects to second mounting plates 26. The pivotal connection of first beam 11 to first mounting plates 24 is accomplished by sliding an appropriately sized pin though the mounting plates 24 and through that portion of first beam 11 that is adapted to fit between the mounting plates 24. Second beam 12 is pivotally connected to mounting plates 26 in an identical fashion. While mounting plate assemblies 24 and 26 are illustrated as the means used to pivotally connect beams 11 and 12 to the base frame 22, any means of pivotal connection are suitable so long as structural integrity can be maintained under the desired load, such as hinges, pin and hole assemblies, or bearing assemblies.

First and second mounting plates 24, 26 are positioned on base frame 22 so as to sit directly over a structural strong point of the plant, for example spent fuel pool wall 27. Cask translocation crane 10 further comprises first hydraulic cylinder 28 and second hydraulic cylinder 29. First hydraulic cylinder 28 is pivotally connected to base frame 22 by mounting plate assembly 31 at one end and pivotally connected to first beam 11 by mounting plate assembly 32 at the other end. Second hydraulic cylinder 29 is pivotally connected to base frame 22 by mounting plate assembly 33 at one end and pivotally connected to second beam 12 by mounting plate assembly 34 at the other end.

While cask translocation crane 10 is illustrated as being secured to base frame 22, it is possible to operate cask translocation crane without using a base frame 22. In such an embodiment, first and second beams 11 and 12 will be pivotally connected directly to the floor or other supporting structure within the power plant via mounting brackets or any of the other types of means for pivotal connection mentioned above or known in the art.

FIG. 1 illustrates cask translocation crane 10 having unitary frame 25 oriented in a substantially upright position (i.e., first and second beams 11 and 12 are substantially perpendicular to the horizon). First and second hydraulic cylinders 28, 29 are capable of expanding and contracting in size. Expanding the size of first and second hydraulic cylinders 28, 29 rotates unitary structure 25 in a counterclockwise direction about axis A-B. Reducing the size of first and second hydraulic cylinders 28, 29 rotates unitary structure 25 in a clockwise direction about axis A-B.

Referring to FIG. 2, a second embodiment of cask translocation crane 10 adapted to allow translational motion of unitary structure 25 is shown. Elements present in the embodiment of the cask translocation crane of FIG. 1 are given like numbers in FIG. 2. In order to avoid redundancy, discussion of the embodiment illustrated in FIG. 2 will be limited to those aspects of cask translocation crane 10 that are different than the crane of FIG. 1.

Base frame 22 of cask translocation crane 10 comprises first track 38, second track 39, first carriage 40, and second carriage 41. First carriage 40 is adapted to rest and ride atop first track 38. Similarly, second carriage 41 is adapted to rest and ride atop second track 39. A plurality of guide plates 42 are secured to the sides of both first and second carriages 40, 41, extending below the carriages 40, 41 and over the sides of first and second tracks 38, 39. Guide plates 42 ensure that first and second carriages 40, 41 remain on first and second tracks 38, 39 and help guide the carriages 40, 41 while riding thereon. The translation motion (i.e. riding) of carriages 40, 41 atop first and second tracks 38, 39 is facilitated by the use of rollers or bearings (not illustrated) built into the bottom of the carriages 40, 41.

Cask translocation crane 10 of FIG. 2 further comprises third hydraulic cylinder 36 and fourth hydraulic cylinder 37 to facilitate rotation of unitary structure 25 about axis A-B. At one end, first hydraulic cylinder 28 and third hydraulic cylinder 36 are pivotally connected to opposing sides of first beam 11 at mounting plate assemblies 32 and 43 respectively. At their opposite ends, first hydraulic cylinder 28 and third hydraulic cylinder 36 are pivotally connected to first carriage 40 at mounting plate assemblies 31 and 44 respectively. Similarly, second hydraulic cylinder 29 and fourth hydraulic cylinder 37 are pivotally connected to opposing sides of second beam 12 at mounting plate assemblies 34 and 45 respectively. At their opposite ends, second hydraulic cylinder 29 and fourth hydraulic cylinder 37 are pivotally connected to second carriage 41 at mounting plate assemblies 33 and 46 respectively.

First and second beams 11, 12 are pivotally connected to first and second carriages 40, 41 via first and second mounting plates 24, 26 (not visible)similar to that which is shown in FIG. 1. As such, when first and second carriages are translationally moved along tracks 38, 39 unitary structure 25 also translationally moves therewith while remaining capable of rotating about axis A-B. The energy required to translationally move unitary structure 25 and carriages 40, 41 along tracks 38, 39 can be provided by known methods in the art including a motor, hydraulic cylinders, or manually.

Figure 3:
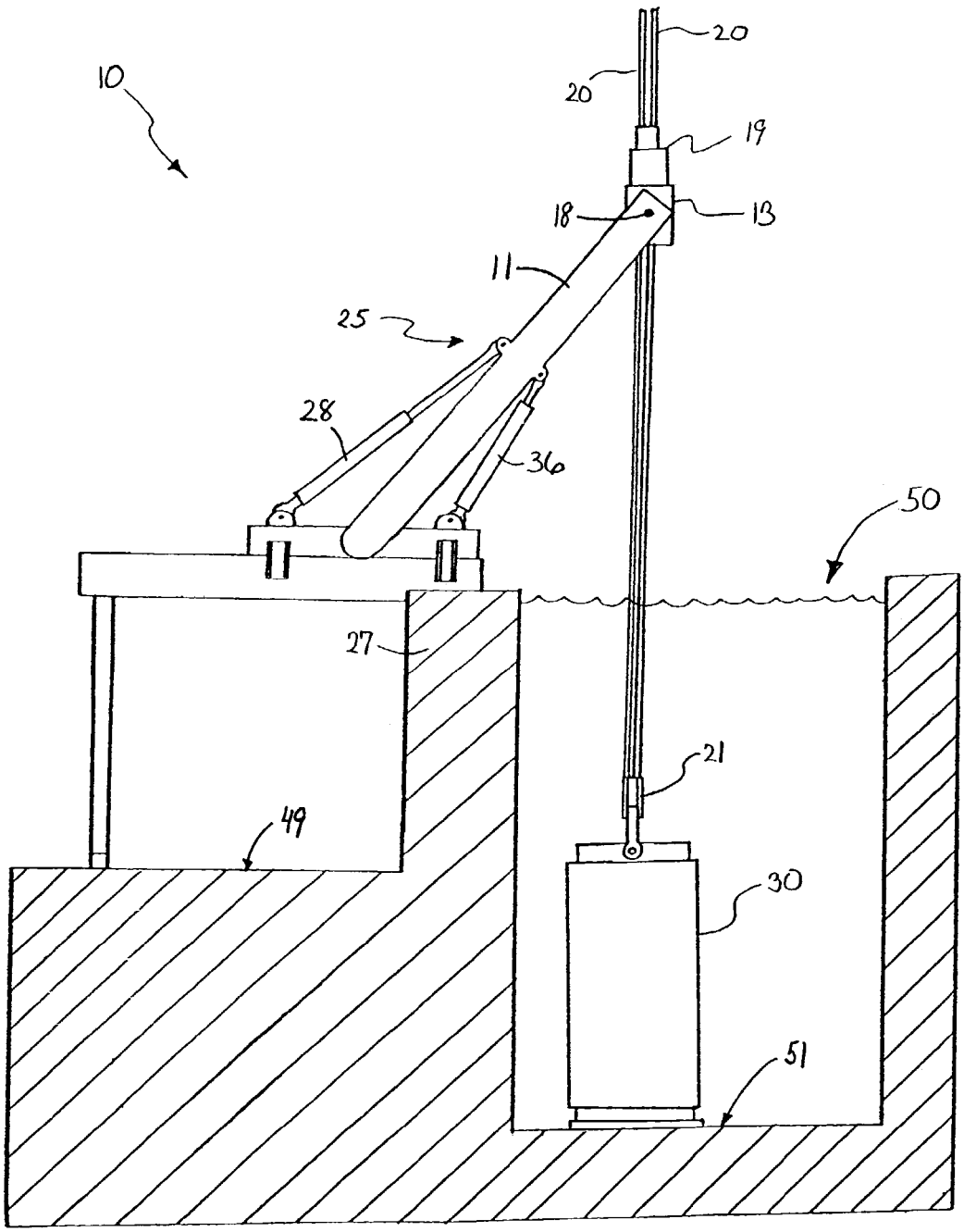
FIG. 3 is a side view of the cask translocation crane of FIG. 2 connected to an SNF loaded transfer cask positioned on the floor of the spent fuel pool.

As illustrated in FIG. 2, cask translocation crane 10 is situated above a canister staging area 49 next to spent fuel pool 50 (FIG. 3). Specifically, first and second tracks 38, 39 are secured to fuel pool wall 27 via load distribution blocks 47. Load distribution blocks 47 are positioned within wall 27 and are adapted to secure tracks 38, 39 to wall 27 while minimizing the danger of structural damage to wall 27. Base frame 22 further comprises support beams 48 for supporting and maintaining tracks 38, 39 in a substantially horizontal position.

Figure 9:
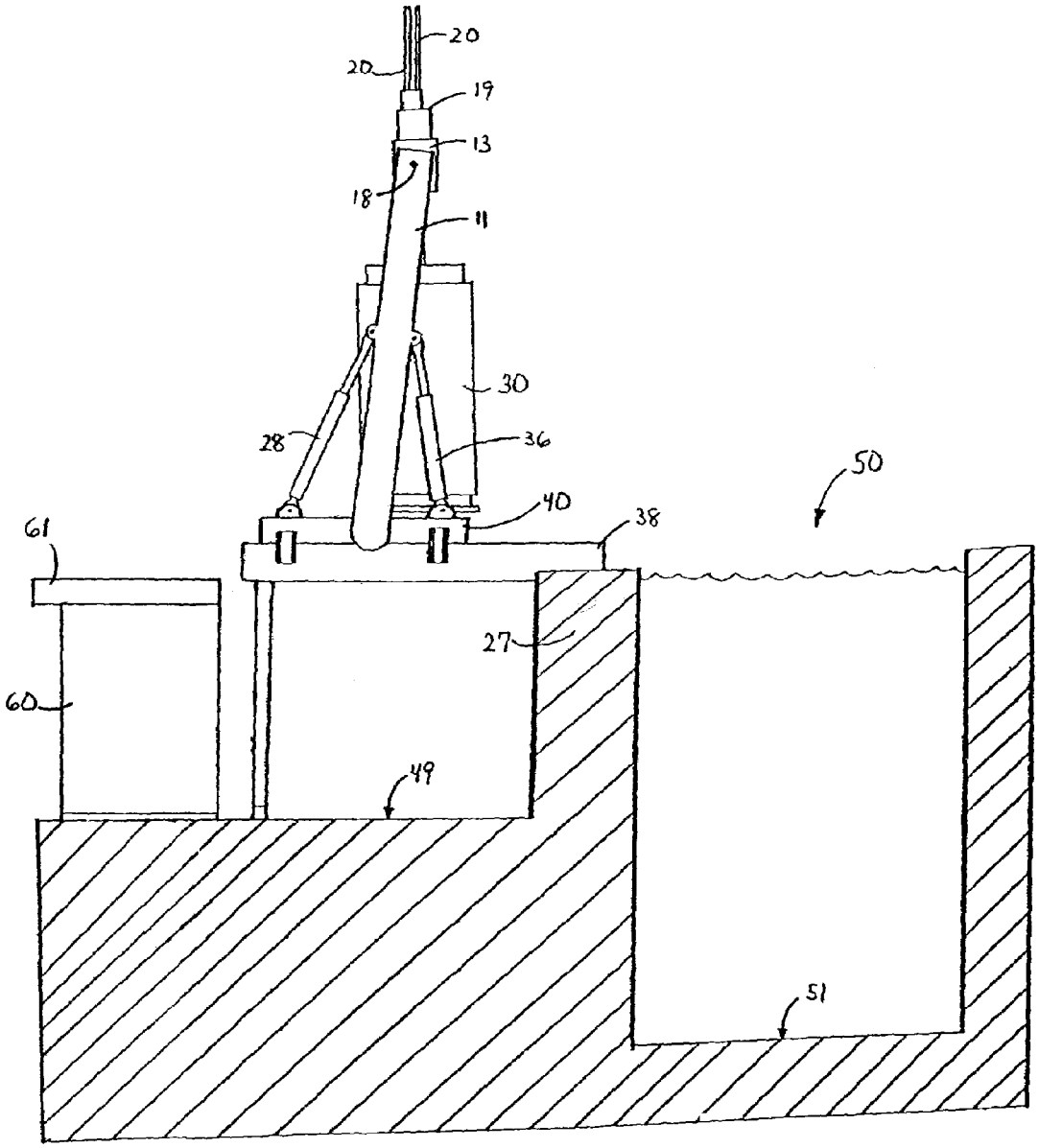
FIG. 9 is a side view of the cask lifting apparatus of FIG. 2 positioned to the left of the cask staging area and holding the SNF loaded transfer cask above the cask staging area.
Figure 10:
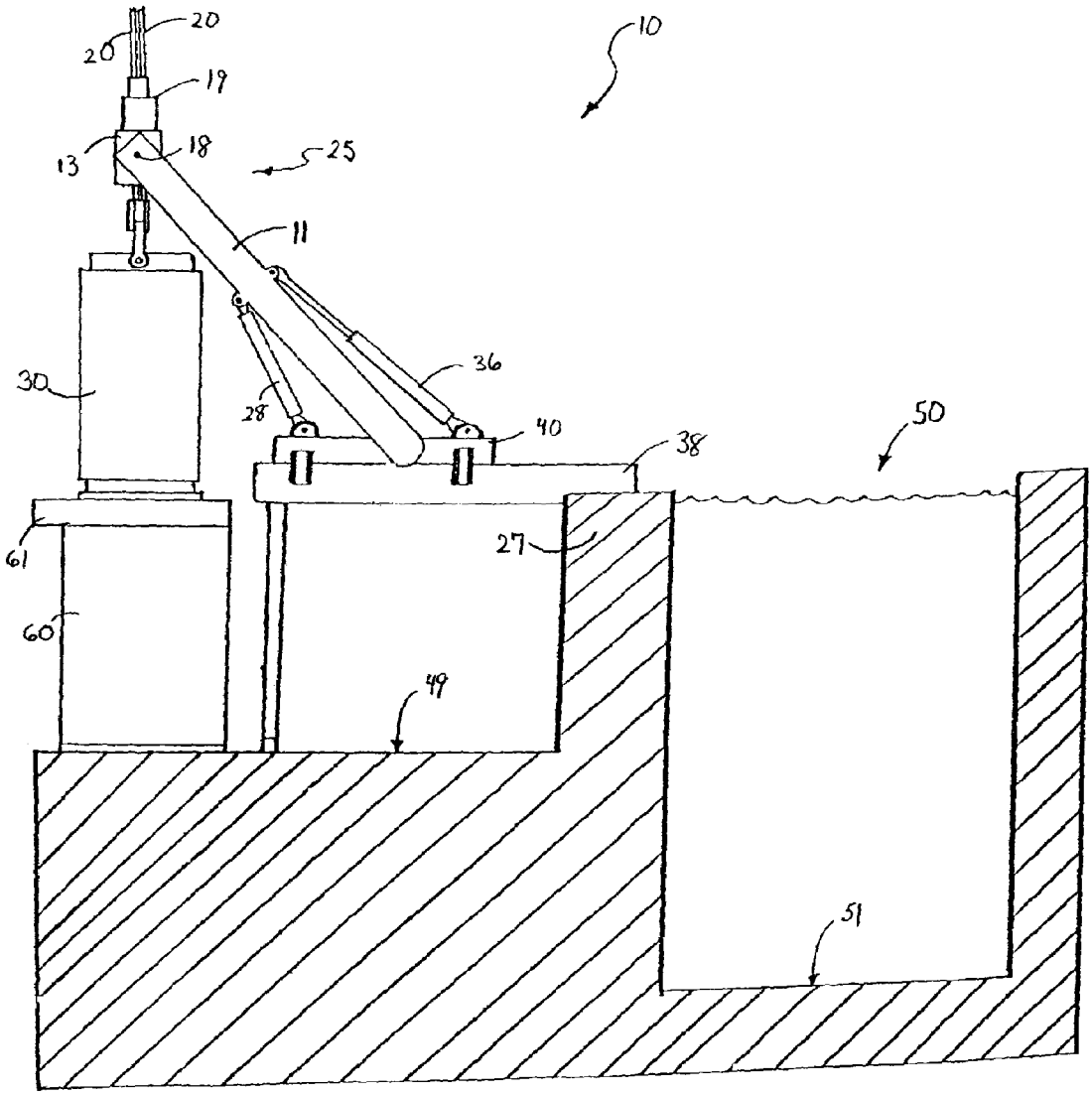
FIG. 10 is a side view of the cask translocation crane of FIG. 2 positioned to the left of the cask staging area with the SNF loaded transfer cask placed atop the storage cask.
Figure 11:
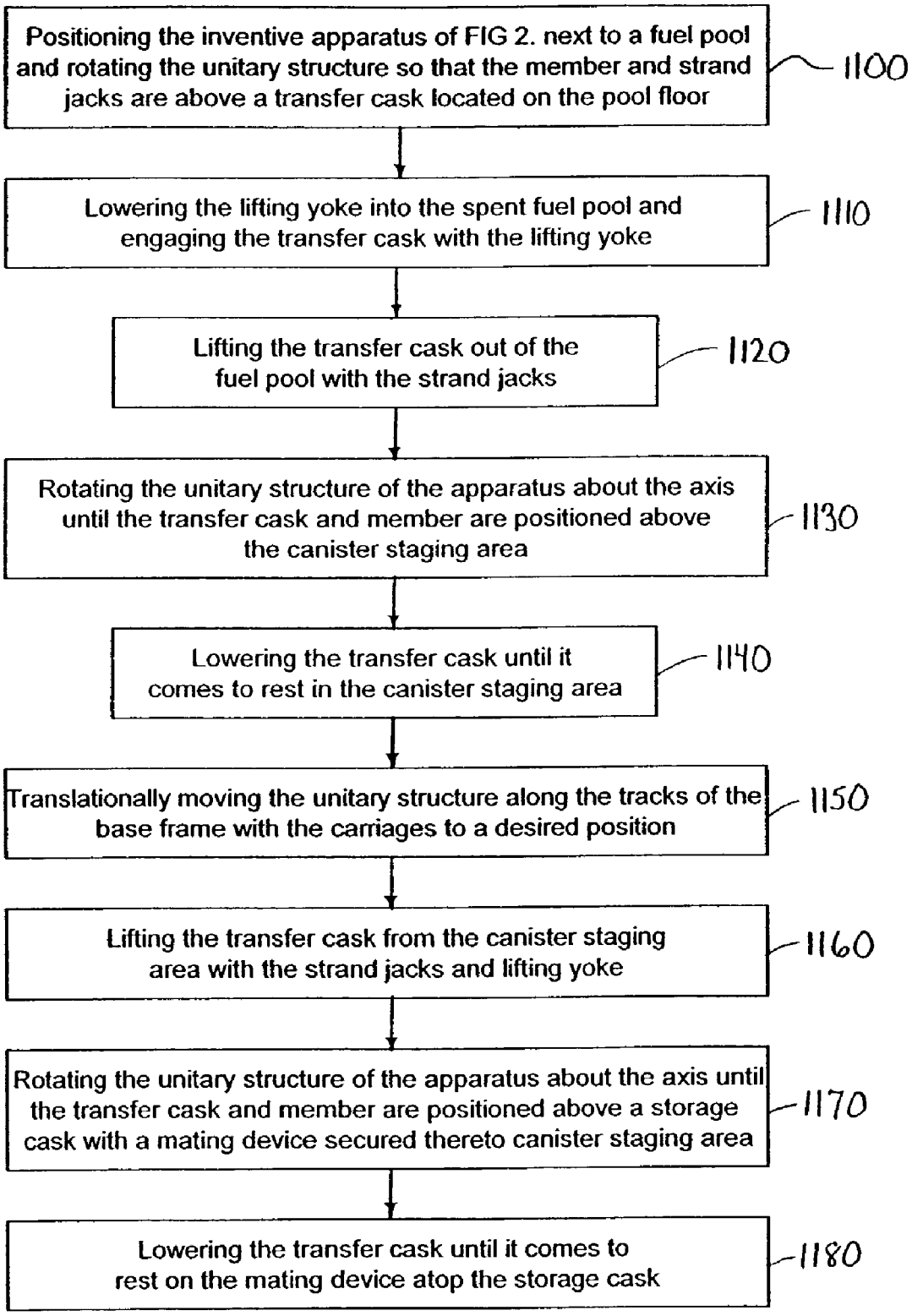
FIG. 11 is a flow chart of an embodiment of a method of transferring SNF from a spent fuel pool to a storage cask according to the present invention.

Referring now to FIG. 11, a method of transferring a canister of SNF from a spent fuel pool to a storage cask using the apparatus of FIG. 2 will be discussed in detail below with reference to FIGS. 2–10.

Cask translocations crane 10 is positioned adjacent to a spent fuel pool 50. Transfer cask 30 (including a canister loaded with SNF) is positioned on pool floor 51. Assuming that cask translocation crane 10 begins with unitary structure 25 in a substantially upright position, the first step is to rotate unitary frame 25 in a clockwise direction about axis A-B so that member 13 and strand jack 19 are positioned above transfer cask 30, completing step 1100. Unitary frame 25 is rotated in a counterclockwise direction by activating hydraulic cylinders 28, 29, 36, 37 so that first and second hydraulic cylinders 28, 29 expand while third and fourth hydraulic cylinders 36, 37 contract. Once positioned above transfer cask 30, lifting yoke 21 is lowered into fuel pool 50 by turning strand jack 19 in the proper direction releasing braided cables 20. Once adequately lowered, lifting yoke 21 is engaged to transfer cask 30 as is illustrated in FIG. 3, completing step 1110. Because member 13 is pivotally connected to first and second beams 11, 12 at pivot points 18, member 13 keeps strand jacks 19 in a substantially vertical orientation, reducing stresses on the cables 20 and other lifting equipment.

Figure 4:
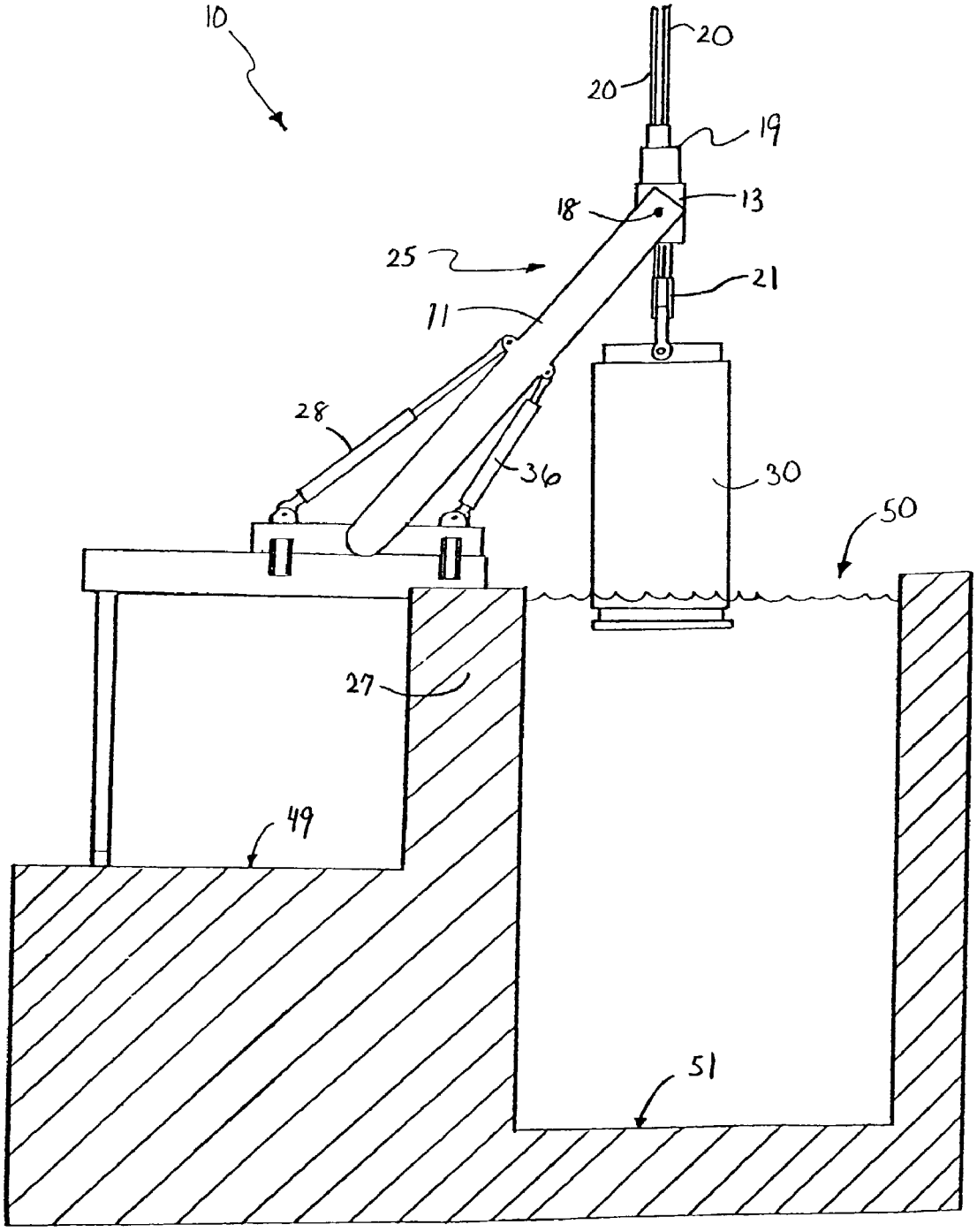
FIG. 4 is a side view of the cask translocation crane of FIG. 2 holding the SNF loaded transfer cask above the spent fuel pool.

When lifting yoke 21 is properly engaged to transfer cask 30, strand jack 19 is turned in the direction opposite in which it was turned to lower lifting yoke 21, causing cables 20 and lifting yoke 21 be drawn upward and lifting transfer cask 30, completing step 1120. Strand jacks 19 continue to be turned until transfer cask 30 is in a fully raised position, as illustrated in FIG. 4.

Figure 5:
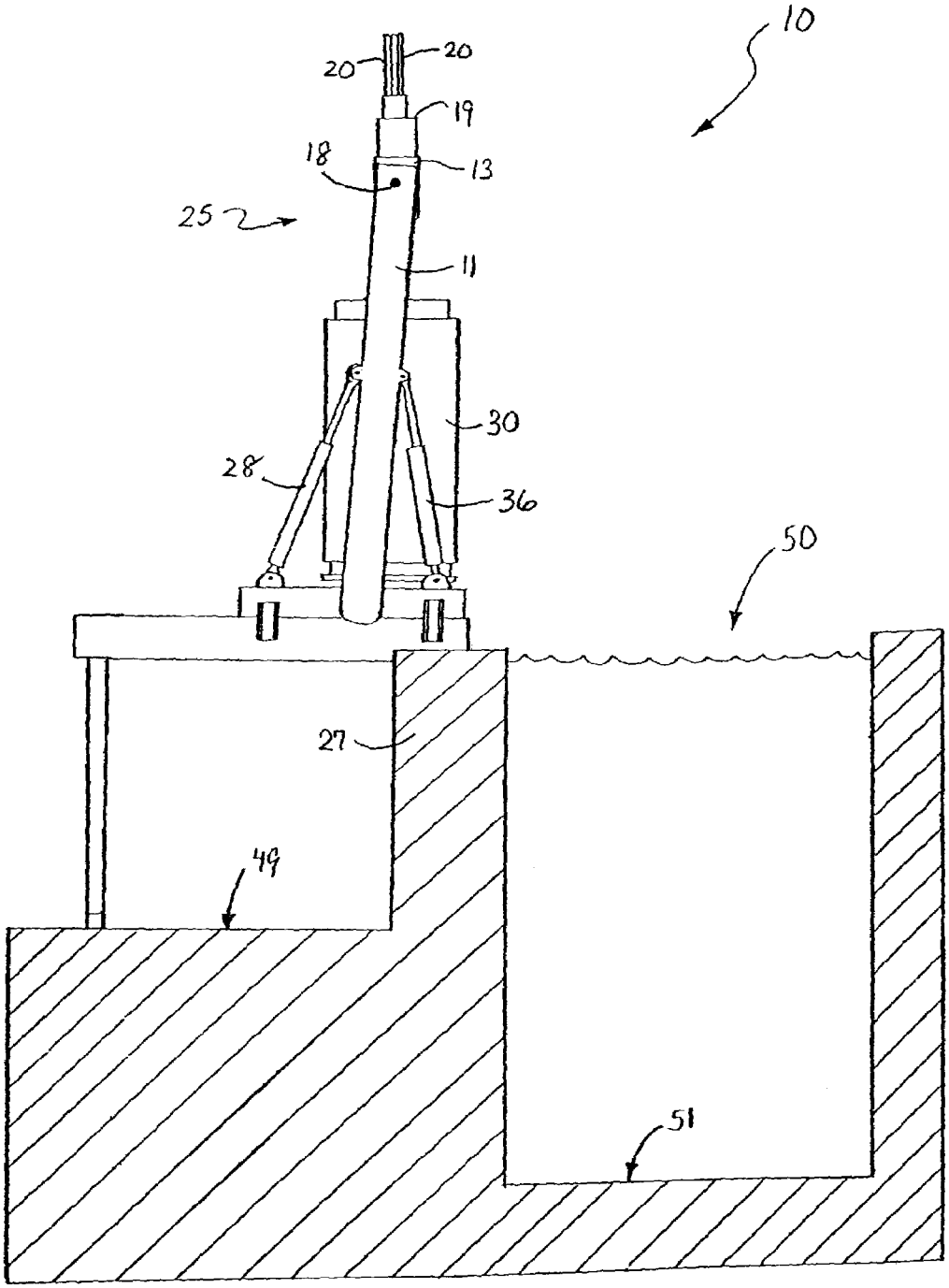
FIG. 5 is a side view of the cask translocation crane of FIG. 2 holding the SNF loaded transfer cask above the area adjacent to the spent fuel pool.

Once transfer cask 30 is in the fully raised position, hydraulic cylinders 28, 29, 36, 37 are activated. By activating hydraulic cylinders 28, 29, 36, 37 so that first and second hydraulic cylinders 28, 29 contract while third and fourth hydraulic cylinders 36, 37 expand, unitary structure 25 will rotate about axis A-B in a counterclockwise direction, until transfer cask 30 passes between first and second beams 11, 12, as illustrated in FIG. 5. First and second beams 11, 12 are separated by a distance D (FIG. 1). D is sized so that transfer cask 30 can pass between first and second beams 11, 12, causing first and second beams 11, 12 to straddle transfer cask 30 as it passes there between. Preferably, cask translocation crane 10 does not have any structures, besides member 13, connecting first and second beams 11, 12.

Figure 6:
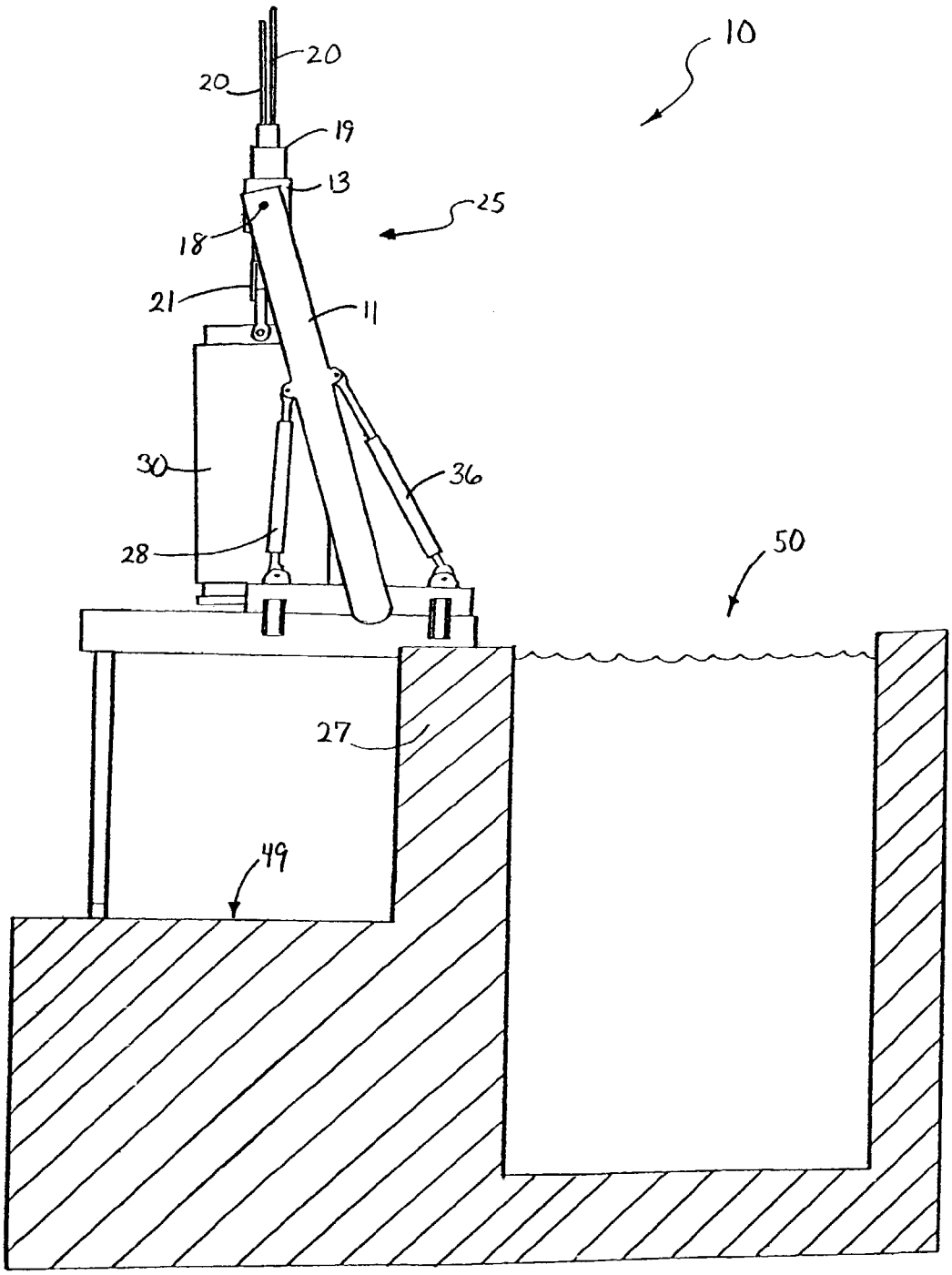
FIG. 6 is a side view of the cask translocation crane of FIG. 2 holding the SNF loaded transfer cask above a cask staging area.
Figure 7:
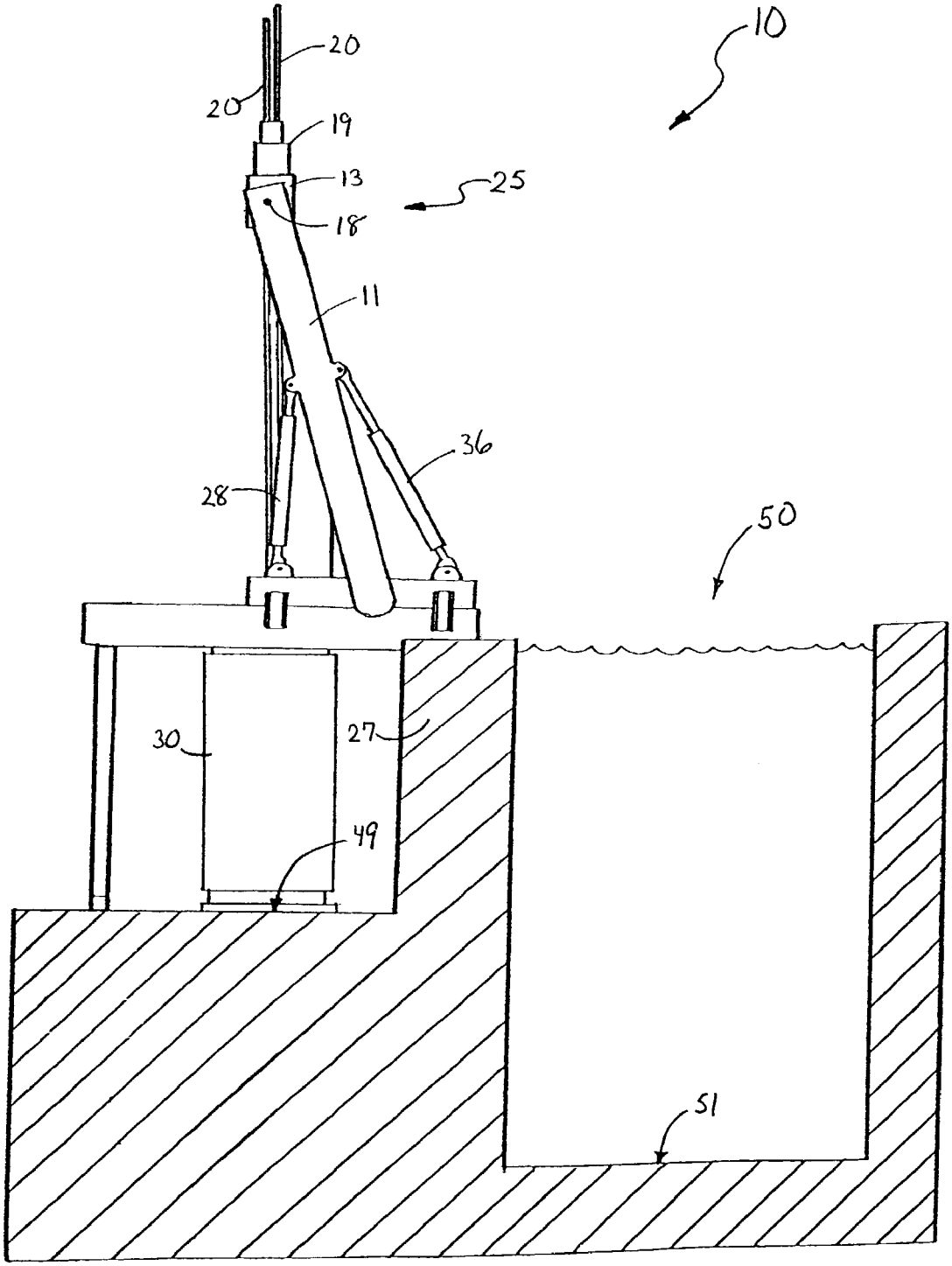
FIG. 7 is a side view of the cask translocation crane of FIG. 2 with the SNF loaded transfer cask lowered onto the cask staging area

Counterclockwise rotation of unitary structure 25 is continued until transfer cask 30 and member 13 comprising strand jacks 19 are above canister staging area 49 as is illustrated in FIG. 6, completing step 1130. Strand jacks 19 are once again turned so as to lower lifting yoke 21 and transfer cask 30. Transfer cask 30 is lowered until it comes to rest in canister staging area 49 as is illustrated in FIG. 7, completing step 1140.

Figure 8:
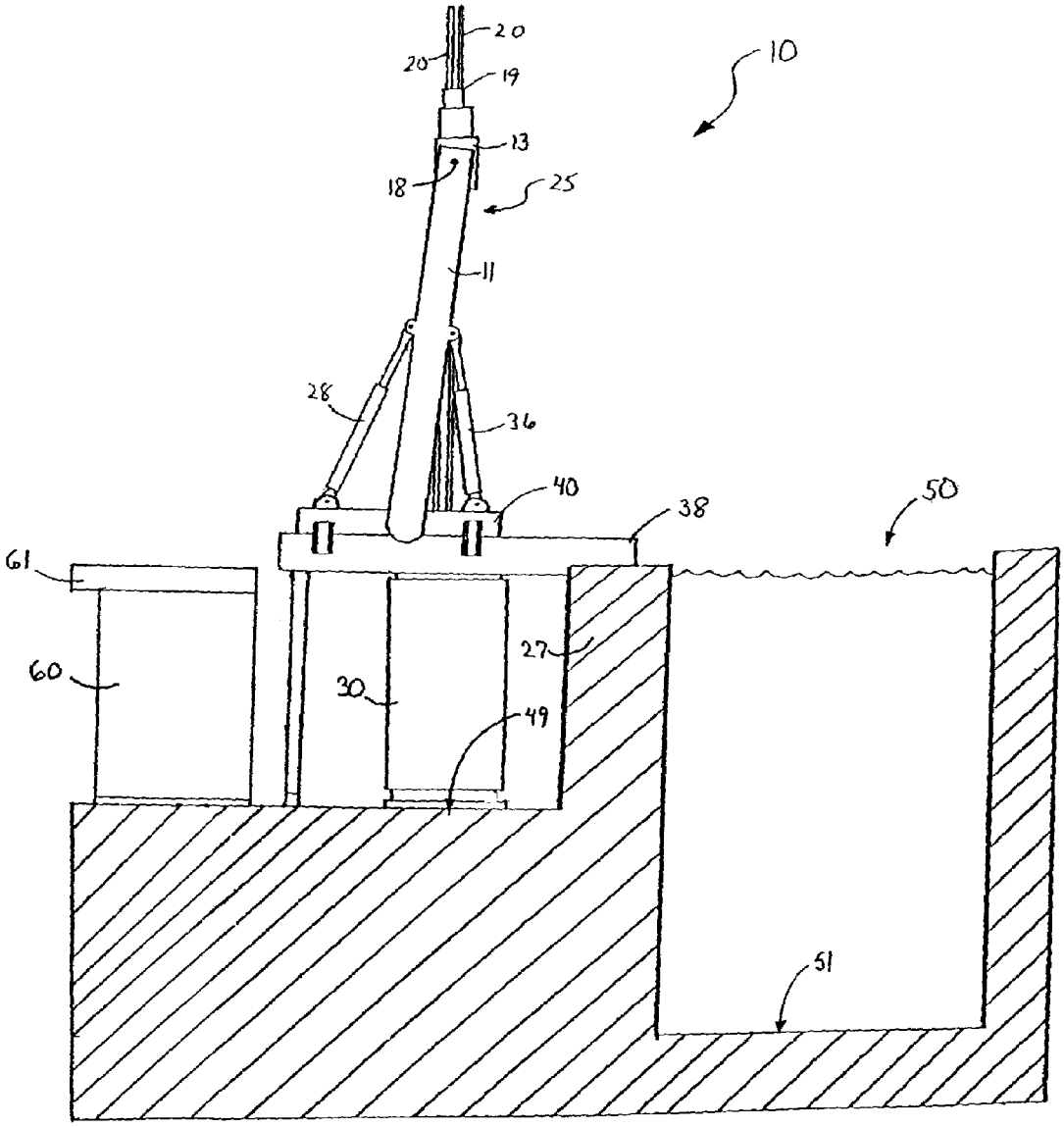
FIG. 8 is a side view of the cask translocation crane of FIG. 2 with the SNF loaded transfer cask positioned in the cask staging area, the cask translocation crane positioned to the left of the cask staging area, and a storage cask positioned near the cask staging area.

The canister, which is within transfer cask 30, is then prepared for long-term dry storage using procedures known in the art. At this point, first and second carriages 40, 41 are moved horizontally along tracks 38, 39 causing unitary structure 25 to translationally move to the left until the position illustrated in FIG. 8 is reached, thus completing step 1150. Storage cask 60 is positioned nearby. Mating device 61 is secured to the top of storage cask 60 and is adapted to be secured both thereto and to the bottom of transfer cask 30 to facilitate transfer of the SNF-loaded canister to the storage cask 60 without exposing the environment to radiation.

Strand jacks 19 are once again turned in the direction that will draw in braided cables 20 and lift transfer cask 30. Lifting of transfer cask 30 is continued by turning strand jacks 19 until the transfer cask 30 is in a fully raised position above staging area 49 as is illustrated in FIG. 9, thus completing step 1160.

Unitary structure 25 is then rotated about axis A-B in a counterclockwise direction as described above until transfer cask 30 is positioned above storage cask 60 and mating device 61, completing step 1170. Transfer cask 30 is then lowered onto mating device 61 atop storage cask 61 as illustrated in FIG. 10, completing step 1180. Transfer cask 30 is secured to mating device 61 and the SNF-loaded canister is then lowered into storage cask 60. Storage cask 60 is then sealed for long-term storage.

The elements/structures of cask translocation crane 10 are constructed of combinations of structural I-beams, structural shapes, carbon steel plate, and rounds. Components of cask translocation crane 10 that contact the water of pool 50 can be constructed of stainless steel, but painted carbon steel is preferred.

While the invention and preferred embodiments have been described and illustrated in sufficient detail that those skilled in this art may readily make and use the invention, various alternatives, modifications and improvements should become readily apparent to this skilled in this art without departing from the spirit and scope of the invention.

What is claimed is:

1. An apparatus for transferring a cask from a first position to a second position comprising:

a first beam having a first proximal end and a first distal end, said first proximal end adapted for pivotal connection to a base;

a second beam having a second proximal end and a second distal end, said second proximal end adapted for pivotal connection to said base;

a member connecting said first distal end and said second distal end, said member comprising a lifting device adapted to raise and lower said cask;

wherein said member, said first pivot beam, and said second pivot beam form a unitary structure; and means to rotate said unitary structure about an axis, said rotational means comprising first and third hydraulic cylinders pivotally connected to opposing sides of said first beam and second and fourth hydraulic cylinders pivotally connected to opposing sides of said second beam.

2. The apparatus of claim 1 wherein said lifting device comprises a lift yoke for engaging a spent nuclear fuel containment cask.

3. The apparatus of claim 1 wherein said lifting device comprises one or more strand jacks.

4. The apparatus of claim 1 wherein said unitary structure is an upside-down substantially U-shaped structure.

5. The apparatus of claim 1 wherein said member is pivotally connected to said first and second distal ends.

6. The apparatus of claim 1 further comprising said base, said base comprising a base frame, said first and second beams pivotally connected to said base frame.

7. The apparatus for transferring a cask from a first position to a second position comprising:

a base comprising a base frame;

a first beam having a first proximal end and a first distal end, said first proximal end pivotally connected to said base frame;

a second beam having a second proximal end and a second distal end, said second proximal end pivotally connected to said base frame;

a member connecting said first distal end and said second distal end, said member comprising a lifting device adapted to raise and lower said cask;

wherein said member, said first pivot beam, and said second pivot beam form a unitary structure; and means to rotate said unitary structure about an axis;

wherein said base frame comprises first and second carriages and first and second tracks, said first and second carriages adapted to ride on said first and second tracks respectively.

8. The apparatus of claim 7 wherein said first and second beams are pivotally connected to said first and second carriages respectively, allowing translational motion of said unitary frame with respect to said tracks.

9. The apparatus of claim 8 wherein said rotational means comprises first, second, third, and fourth hydraulic cylinders, said first and third hydraulic cylinders connected to opposing sides of said first beam and to said first carriage, said second and fourth hydraulic cylinders connected to opposing sides of said second pivot beam and to said second carriage.

10. The apparatus of claim 6 wherein said first and second beams are pivotally connected to said base frame so that said unitary structure is incapable of translational motion with respect to said base frame.

11. The apparatus of claim 10 wherein said base frame comprises first and second mounting brackets, said first and second beams pivotally connected to said first and second mounting brackets respectively.

12. The apparatus of claim 7 wherein said first and second beams are adapted to pivotally connect to said base to allow said unitary structure to rotate in both a clockwise and counterclockwise direction from a substantially upright position.

13. The apparatus of claim 7 wherein said apparatus is adapted to allow said cask to pass between said first and second beams.

14. The apparatus of claim 13 wherein said first and second beams are separated by a distance that is at least as wide as said cask.

15. A method of transferring a cask comprising:

providing an apparatus comprising a base comprising a base frame, a first beam having a first proximal end and a first distal end, said first proximal end pivotally connected to a base; a second beam having a second proximal end and a second distal end, said second proximal end pivotally connected to said base; a member connecting said first distal end and said second distal end, said member comprising a lifting device adapted to raise and lower said cask, said lifting member comprising a means to engage a spent nuclear fuel containment cask; wherein said member, said first pivot beam, and said second pivot beam form a unitary structure; and means to rotate said unitary structure about an axis, wherein said base frame comprises first and second carriages and first and second tracks, said first and second carriages adapted to ride on said first and second tracks respectively;

engaging a spent nuclear fuel containment cask located in a first position with the engagement means;

lifting said spent nuclear fuel containment cask with said lifting device;

translating said unitary structure and said spent nuclear fuel containment cask along said first and second tracks;

rotating said unitary structure about said axis so that said cask is above a second position; and lowering said cask onto said second position.

16. The method of claim 15 wherein said first position is within a spent fuel pool and said second position is a staging area.

17. The method of claim 15 wherein said first position is a staging area and said second position is atop a storage cask.

18. The method of claim 15 wherein when said unitary structure is rotated about said axis so that said cask is above a second position, said cask passes between said first and second beams.

* * * * *